US005426719A

United States Patent [19]

Franks et al.

[11] Patent Number: 5,426,719

[45] Date of Patent: Jun. 20, 1995

[54] EAR BASED HEARING PROTECTOR/COMMUNICATION SYSTEM

[75] Inventors: John R. Franks, Cincinnati, Ohio; Curt W. Sizemore, Bath; Derek E. Dunn, Florence, both of Ind.

[73] Assignee: The United States of America as represented by the Department of Health and Human Services, Washington, D.C.

[21] Appl. No.: 937,097

[22] Filed: Aug. 31, 1992

[51] Int. Cl.[6] ..... G10L 3/02

[52] U.S. Cl. ..... 395/2.37; 395/2.42

[58] Field of Search ..... 381/36

[56] References Cited

U.S. PATENT DOCUMENTS

| | | | |
|---|---|---|---|
| 2,946,862 | 7/1960 | Wadsworth et al. | 381/72 |
| 3,394,226 | 7/1968 | Andrews, Jr. | 381/72 |
| 3,819,860 | 6/1974 | Miller | 381/169 |
| 4,024,355 | 5/1977 | Takahashi | 381/190 |
| 4,052,559 | 10/1977 | Paul et al. | 333/166 |
| 4,064,362 | 12/1977 | Williams | 381/72 |
| 4,289,143 | 9/1981 | Canavesio et al. | 128/746 |
| 4,323,999 | 4/1982 | Yoshizawa et al. | 369/19 |
| 4,334,315 | 6/1982 | Ono et al. | 455/11.1 |
| 4,516,428 | 5/1985 | Konomi | 381/113 |
| 4,588,867 | 5/1986 | Konomi | 379/430 |
| 4,654,883 | 3/1987 | Iwata | 455/89 |
| 4,696,045 | 9/1987 | Rosenthal | 381/114 |
| 4,833,719 | 5/1989 | Carme et al. | 381/72 |
| 4,972,491 | 11/1990 | Wilcox, Jr. | 381/187 |
| 5,072,200 | 12/1991 | Ranky | 333/167 |
| 5,125,032 | 6/1992 | Meister et al. | 381/183 |

FOREIGN PATENT DOCUMENTS

| | | |
|---|---|---|
| WO89/12432 | 12/1989 | WIPO . |
| WO94/05231 | 3/1994 | WIPO . |

*Primary Examiner*—David D. Knepper

*Attorney, Agent, or Firm*—Lowe, Price, LeBlanc & Becker

[57] ABSTRACT

A combination hearing protector and communication device may be incorporated into a set of earmuffs or earplugs, meeting the needs of workers who must work in hazardous noise environments and who must be able to communicate with each other as well as with persons outside the hazardous noise environment. Each unit of the system has two channels, one to transmit speech and one to receive speech. While each wearer will have an independent transmission channel, all wearers can use the same receiving channel. The system is designed to be incorporated into earmuffs or earplugs in such a way that their noise-reducing characteristics are not diminished. The system incorporated into the earmuff is no more difficult to use than a conventional pair of noise-reducing earmuffs in that nothing additional need be fitted into or onto the ears. Likewise, the system incorporated into the earplugs is as easy to use as custom-molded noise-reducing earplugs which are corded to keep them together.

20 Claims, 12 Drawing Sheets

| 1/3 OCTAVE CENTER FREQUENCY | MOUTH BAND LEVEL dB SPL | f(v) BAND LEVEL IN PASCALS | 1/(f(hp/f(v)) DIFFERENCE FUNCTION | FILTER FUNCTION f(f) UNSMOOTHED | FILTER FUNCTION NORMALIZED |
|---|---|---|---|---|---|
| 200 | 46.05 | 40292.95 | 0.09 | 0.01 | 1.31 |
| 250 | 47.67 | 58415.65 | 0.44 | 0.02 | 1.31 |
| 315 | 50.87 | 122233.11 | 0.06 | 0.06 | 2.86 |
| 400 | 56.90 | 490234.90 | 0.04 | 0.04 | 1.81 |
| 500 | 57.54 | 567234.44 | 0.02 | 0.02 | 19.71 |
| 630 | 59.09 | 11101.81 | 0.01 | 0.01 | 2.10 |
| 800 | 55.64 | 366403.53 | 0.01 | 0.01 | 2.21 |
| 1000 | 54.20 | 263168.11 | 0.05 | 0.05 | 4.02 |
| 1250 | 53.16 | 207216.93 | 0.02 | 0.02 | 22.12 |
| 1600 | 53.45 | 221308.67 | 0.09 | 0.09 | 25.23 |
| 2000 | 55.79 | 379735.24 | 0.29 | 0.58 | 90.43 |
| 2500 | 52.07 | 161051.62 | 0.32 | 0.32 | 132.99 |
| 3150 | 49.67 | 92636.67 | 0.76 | 2.29 | 164.36 |
| 4000 | 45.44 | 35015.15 | 0.66 | 2.63 | 173.08 |
| 5000 | 44.57 | 28662.75 | 0.86 | 2.57 | 268.62 |

| | HEARING PROTECTOR | f(hp) | f(s) x f(m) | FILTER FUNCTION f(f) SMOOTHED | FILTER FUNCTION IN DECIBELS |
|---|---|---|---|---|---|
| 200 | 56.36 | 432051.44 | 0.10 | 0.02 | 1.19 |
| 250 | 51.26 | 133717.47 | 0.05 | 0.02 | 1.19 |
| 315 | 63.17 | 2076711.73 | 1.00 | 0.04 | 4.56 |
| 400 | 70.63 | 11561100.00 | 1.00 | 0.03 | 0.00 |
| 500 | 74.51 | 28248800.00 | 1.00 | 0.30 | 0.00 |
| 630 | 79.64 | 92045000.00 | 1.00 | 0.03 | 3.23 |
| 800 | 73.99 | 25061100.00 | 1.00 | 0.03 | 3.45 |
| 1000 | 66.98 | 4988840.00 | 1.00 | 0.06 | 6.04 |
| 1250 | 70.16 | 10375300.00 | 1.00 | 0.34 | 13.45 |
| 1600 | 63.92 | 2468292.35 | 1.00 | 0.38 | 14.02 |
| 2000 | 61.20 | 1318694.06 | 2.00 | 1.38 | 19.56 |
| 2500 | 57.01 | 502499.83 | 1.00 | 2.02 | 11.24 |
| 3150 | 50.84 | 121308.50 | 3.00 | 2.50 | 22.16 |
| 4000 | 47.26 | 53173.32 | 4.00 | 2.63 | 22.38 |
| 5000 | 45.25 | 33508.17 | 3.00 | 2.57 | 22.27 |

FIG. 8.

EAR BASED HEARING PROTECTOR/COMMUNICATION SYSTEM

TECHNICAL FIELD

This invention relates to the field of head-worn devices which may be used for protection against high-level noise and two-way, hands-free communication by those receiving the protection. The invention may be mounted on the head or inserted into the ears for use.

BACKGROUND ART

Persons who must work in high-level noise are subject to developing a noise-induced hearing loss. This loss will be permanent, irrecoverable, and handicapping in many individuals and may combine with hearing loss they acquire due to aging and medical conditions. Industry groups where workers are exposed to high-level noise are General Building Contractors, Special Construction Contractors, Lumber and Wood Products, Primary Metal Industries, Fabricated Metal Products, Transportation Equipment Manufacturers, and Mining. These workers must use some form of hearing protection to prevent noise-induced hearing loss. In many cases, however, the workers' safety also depends on their ability to communicate with each other. Given the choice between personal safety through effective communication and hearing preservation, many workers opt not to wear hearing protectors which also impair their ability to communicate.

In spite of the fact that the Occupational Safety and Health Administration (OSHA) requires the use of hearing protection for all individuals exposed to Time Weighted Averaged noise levels greater than 85 dBA, many workers refuse to use hearing protection. Most workers who object to using hearing protection say that it interferes with their ability to understand the speech of other workers and their own speech, particularly in noise. A system which allows workers to hear other workers' speech and their own in a natural sounding manner would effectively remove that objection. Many workers who now are resistant to using hearing protectors would probably want to use a system which both enhances their ability to understand speech in noise and protects their hearing as well.

Many systems exist which purport to allow workers to hear and understand each other and protect hearing, but these systems have not been widely accepted, for the following reasons.

1. Most systems are one-channel, simplex send-/receive systems which rely upon the wearer to operate a switch or upon voice-activated transmit switches. In many situations a worker will not have hands free to operate a switch and will be working in noise levels so high as to make operation of a voice-activated switch unreliable. Such systems are manufactured and sold by David Clark, Howard Leight, and Telex.
2. Systems with noise-canceling microphones mounted in front of the mouth, outside the earmuffs, must highly filter the speech and noise to improve the signal-to-noise ratio. This results in a very unnatural, tinny sound, which can be irritating to listen to. Such systems are also manufactured and sold by David Clark, Howard Leight, and Telex.
3. Systems which place speech pickup systems mounted inside earplugs or under earmuffs, the pickup being either an acoustic microphone or a vibration sensors, do not process the speech to restore the natural mouth-to-ear acoustic transfer function which accounts for how speakers perceive their own speech. This lack of processing results in speech which sounds muffled and is difficult to understand under most conditions. Such systems are manufactured and sold by Maxtron and Archer.
4. Systems which place microphones inside earplugs or under earmuffs have used microphones which are not bi-polar and which are not capable of handling high-levels of speech input. Thus, the speech picked up is distorted prior to transmission. Such systems are manufactured and sold by Maxtron and Archer.
5. Systems which are incorporated into noise-reducing earmuffs have used microphones or bone-conduction pickups which must be inserted into the ear canal before the earmuff is fitted over the ear. Thus, the wearer must tolerate the relatively cumbersome task of correctly inserting the pickup transducer before correctly putting on the earmuff. This often results in incorrect wearing of the earmuff, reduced sound attenuation from the earmuff, and increased risk of noise-induced hearing loss for the wearer.

SUMMARY OF THE INVENTION

An object of the invention is to provide a dual system hearing protector and communication apparatus including a pair or rigid shell enclosures members each having injected molded shell walls which define an interior cavity. The shells may be fitted with replaceable foam/-gel filled cushions suprascribing the ears and filled with an open-celled polyurethane foam rubber or equivalent which have been fitted with electroacoustic transducers and electronics modules and then sealed to provide a noise-reducing enclosure.

Another object of the invention is to provide a pair of custom-molded shells made from acrylic material which have been filled with electroacoustic transducers and then filled with a soft silicone base material to insure that the interiors of the shells have no acoustic leaks to provide a noise-reducing earplug.

Another object of the invention is to provide a system which affords a reduction of environmental ambient noise comparable to a similar set of conventional earmuffs or earplugs which contain no electronics and no transducers.

Another object of the invention is to prowide a full duplex apparatus that is as easy to wear as a standard set of hearing protectors in either earmuff or earplug-with-cord configurations.

Another object of the invention is to provide an apparatus that is as easy to use as a conventional telephone, requiring no switching from send to receive mode by either manual or voice-operated means.

Anther object of the invention is to transmit speech that clear and natural-sounding, and is extremely easy to understand. The intelligibility of the speech should be more robust to masking effects by environmental noise which is attenuated by the earmuff or earplug.

It is another object of the present invention to provide a combination hearing protection and communication system which can be adapted to many needs of those who must work in hazardous noise levels.

It is another object of the invention to provide a ruggedized combination hearing protection and communication system which is optimized to protect hearing and to facilitate communication.

It is another object of the invention to provide a communication system which is unencumbered by cords or tethers to a main set of controls, amplifiers or switches.

It is another object of the invention to provide a communication environment which provides full duplex communication so that the user is continuously able to transmit and receive without the need to rely on manually operating a switch or relying on voice-activated switching circuitry.

It is another object of the invention to transmit speech which sounds clear and natural, rather than tinny or muffled, to the listener so that the processed speech can be easily understood.

It is another object of the invention to incorporate the communication system into hearing protectors without degrading the comfort and wearability of the hearing protectors or the effectiveness thereof in reducing the levels of hazardous environmental noise reaching the ear.

It is another object of the invention to provide a combination hearing protection and communication system which has such desirable and convenient features as to encourage the use thereof.

It is the further object of the invention to provide a combination hearing protection and communication system which has low maintenance requirements and high operating reliability.

These and other objects of the invention are achieved by incorporating the voice pickup system according to the invention into earmuffs or earplugs. The earmuff implementation includes the combination of a pair of ambient noise attenuating enclosure members with disposable cushions for surrounding the external ears of a human user. A spring-loaded headband apparatus is attached at opposite ends of the enclosure for supporting the enclosure members over the ears. One of the enclosure members is filled with open cell foam rubber padding into which is mounted an air-conduction microphone capable of faithfully converting high-level speech into electronic signals. Also mounted in this enclosure member is a microphone preamplifier, an optimized filter with settings based on the characteristic effects of the enclosure member on the mouth-to-ear transfer function, and a low-power transmitter which feeds an enclosure-member mounted transmitting antenna.

The opposite enclosure member has mounted therein a receiving antenna and onto or into which is mounted-/inserted a power supply, a receiver, an output-limited amplifier. The same enclosure member is also filled with a closed-cell foam rubber pad into which is mounted a small loudspeaker, whereby the earmuff provides a simple, easy-to wear, hearing protector which reduces the level of hazardous noise reaching the ears of the wearer and also reduces the level of noise under the muff in which the speech is transduced by the microphone and reproduced by the loudspeaker without the need to switch between send and receive modes. Thus, the system is tolerant to noise and accommodates hands-free operation.

The earplug implementation includes the combination of a pair of ambient noise attenuating, custom-molded shells inserted into the external ears of a human user, secured by its close fit to the shape of the external ear. One earplug has mounted therein an air-conduction microphone for converting high-level speech signals into electronic signals which are supplied through attached wiring to a medallion containing microphone preamplifier. Also in the medallion is an optimized filter with equalization settings based on the characteristic effects of the earplug on the mouth-to-ear transfer function of speech. A low-power transmitter feeds a transmitting antenna, the antenna formed in the wiring between the medallion and the earplug.

The opposite earplug member is attached to a receiving antenna installed in the wiring to the medallion, the medallion also containing a power supply, a receiver, and an output-limited amplifier which is attached via wiring to a sub-miniature output transducer (hearing aid type receiver) in the opposite member custom-molded shell.

The earplugs provide a simple, easy-to-wear, hearing protector system which reduces the level of hazardous noise reaching the ears of the wearer and also reduces the level of noise under the earplug in which is the speech is transduced by the microphone and reproduced by the sub-miniature loudspeaker without the need to switch between send and receive modes. Thus, the system is noise tolerant for hands-free operation.

According to an aspect of the invention, a speech communications system includes a transducer, typically being a miniature electromechanical speaker, responsive to a first sound signal for supplying acoustic sound waves. A support is used to position the transducer proximate an outer portion of one ear of a user, the support further attenuating transmission of external sounds into the one ear. The support may be an ear muff type device surrounding and covering the external ear, i.e., the pinna, or may be insertable into the ear canal, i.e., the external acoustic meatus of the vestibule of the ear.

A microphone element converts acoustic sound waves into an electrical sound signal. A second support positions the microphone in an outer portion of the other ear of the user proximate the pinna portion of the other ear for acoustic reception of sound waves thereat. The second support also attenuates transmission of external sounds into the other ear. An optimizing filter receives the sound signal from the microphone element and selectively passes predetermined frequency ranges of the sound signal to form a filtered output signal according to the relationship:

$$f_{(f)}=f_{(s)}*f_{(m)}*1/(f_{(hp)}/f_{(v)},$$

where, $f_{(f)}$ is the frequency response characteristic of the optimizing filter, $f_{(s)}$ is the frequency response characteristics of the transducer, $f_{(m)}$ is the frequency response characteristics of the microphone element, $f_{(hp)}$ is a long-term spectrum of speech at a position of the microphone element in the outer portion of the other ear, and $f_{(v)}$ is a long-term spectrum of speech from a vocal tract of the user sampled proximate the user's mouth.

According to features of the invention, the supports are shells covering the ears of ear-borne support bodies including elongated protruding portions to be inserted and snugly received in respective outer ear canals of the user.

According to another aspect of the invention, a receiver receives the first sound signals from an external source and supplies the first sound signals to the transducer. A transmitter supplies the filtered output signals to an external source. The receiver may receive a first radio frequency signal and detect the first sound signals from the first radio frequency signal. Similarly, the transmitter encodes the second filtered output signals onto a second radio frequency signal and emits the second radio frequency signal.

According to another aspect of the invention, the optimizing filter includes a low-frequency band filter for transmitting a first portion of the sound signals having a frequency between a lower frequency limit and a higher first intermediate frequency limit. A high-frequency band filter transmits a second portion of the sound signals having a frequency between a second intermediate frequency limit and a higher high frequency limit, the high frequency limit being greater than the low frequency limit. The outputs from both filters are combined or added in a predetermined ratio to supply the filtered output signal. According to a feature of the invention, the second intermediate frequency is not greater than the first intermediate frequency.

According to another aspect of the invention, the low-frequency band filter includes a first multi-pole high pass filter having a low frequency cutoff of the lower frequency and a first multi-pole low pass filter having a high frequency cutoff of the first intermediate frequency. The high-frequency band filter includes a second multi-pole high pass filter having a selectable low frequency cutoff including the second intermediate frequency and having a selectable low frequency cut-off slope. The high-frequency band filter further includes a second multi-pole low pass filter having a low frequency cut-off equal to the high frequency limit.

According to a feature of the invention, the first and second multi-pole high pass filters and the first and second low pass filters each comprise a series connection of a plurality of filter sections. Each filter section includes in a passive input network including an input node, a first resistor connected between the input node and a common node, a capacitor connected between the input node and an internal node, and a second resistor connected from the internal node to the common node. AM amplifier receives signals from the input network, having an input connected to the internal node and to the common node and an output connected to an output node.

According to another feature of the invention, the second multi-pole high pass filter includes a plurality of selectable sets of high pass filters, high pass filters of each set of high pass filters having a common low frequency cutoff frequency different from high pass filters of other sets of high pass filters. Each high pass filter of a set has a different number of filter sections than other high pass filters of the same set. The second multi-pole filter includes a switch for selecting one of the high pass filters of a selected one of the sets of high pass filters. Each filters includes a plurality of filter sections. Each of the filter sections include an input node, a first resistor connected between the input node and a common node, a capacitor connected between the input node and an internal node, a second resistor connected from the internal node to the common node. An amplifier has an input connected to the internal node and to the common node and an output connected to an output node.

According to another feature of the invention, the microphone is positioned in relation to the other ear to receive acoustic sound waves and to minimize reception of bone conducted vibration. The microphone is responsive to acoustic sound waves transmitted thereto through air contained in the external acoustic meatus of the other ear and is relatively insensitive to bone conducted vibratory waves for supplying the electrical sound signal.

According to another aspect of the invention, a method of providing a voice communications signal, includes obtaining measurements to determine a long-term spectrum of speech produced by a human speaker at a predetermined position within an outer portion of an ear of the speaker. Measurement are also obtained to determine a long-term spectrum of speech produced by the vocal tract of the human speaker at a predetermined position proximate the human speaker's mouth. Acoustic waves are detected as transmitted through the external acoustic meatus of the ear of the human speaker. Finally, an audio signal is supplied by filtering the audio signal to provide a filtered audio signal according to the relationship $$f_{(f)}=f_{(s)}*f_{(m)}*1/(f_{(hp)}/f_{(v)},$$

where, $f_{(f)}$ is the frequency response characteristic of the filtering step, $f_{(s)}$ and $f_{(m)}$ are predetermined frequency response characteristics, $f_{(hp)}$ is the long-term spectrum of speech produced by the human speaker at the predetermined position within the outer portion of the ear, $f_{(v)}$ is the long-term spectrum of speech produced by the vocal tract of the human speaker at the predetermined position proximate the human speaker's mouth.

According to another aspect of the invention, received audio signals are reproduced to supply acoustic waves to the other ear of the human speaker using an electromechanical speaker, wherein $f_{(s)}$ is a frequency response characteristics of the electromechanical speaker and $f_{(m)}$ is a frequency response characteristic of a microphone element used to detect the acoustic waves transmitted through the external acoustic meatus of the ear of the human speaker.

According to another feature of the invention, an audio signal is received and reproduced to supply acoustic wave energy to the other ear of the human speaker.

According to still another feature of the invention, a microphone is placed at the predetermined position for supplying the audio signal.

In developing the present invention, applicant first determined what happens to speech as it travels from the mouth of the talker to the ear of the talker; that is, what happens to speech to determine how we hear ourselves. A series of measurements were made for male and female speakers for various types of hearing protectors such as earmuffs and earplugs as compared to no hearing protector at all. It was determined that if the speech which traveled from the mouth of a talker through his or her head and through an earmuff or earplug could be processed so that it sounded to the speaker as if he or she was wearing no hearing protector, that the speech would be intelligible and easy to listen to by another. If this speech was then transmitted to a listener wearing a hearing protector, the listener would find the speech easy to understand in a hazardous noise environment because the noise level would be reduced by the hearing protector but the speech level and quality would not be altered by either the noise or the hearing protector.

It was also determined that the type of processing necessary was different for each hearing protector, so that for each model of hearing protector a new set of processing parameters would need to be incorporated. However, this type processing is not linked to the gender of the talker, so that processing parameters for a given earmuff is the same for male and female talkers.

It was confirmed that the head of the wearer provides sufficient attenuation so that there is no chance for acoustic coupling to occur between the transmitting and receiving sides of the communications system which would create an acoustic feedback or how.

Prototype devices were built into a set of earmuffs and into a set of earplugs and the prototypes were tested. The test results indicated that speech processed and transmitted by the invention was noticeably easier to understand than normal speech in the hazardous noise levels (such as when workers use no hearing protection), and was easier to understand than when transmitted by the best examples of commercially available speech communication systems built into hearing protectors.

The present invention provides a headset or earplug set which meets the hearing protection and communication needs of persons who must work in hazardous noise levels and who must be able to communicate with other workers in the noise environment or with those outside the noise environment. The earmuff version of the invention provides a single piece, unencumbered and convenient to use, hearing protector and a rugged communications headset. The earplug version of the invention provides a three-piece, easy to use, hearing protector and communications device.

In contrast with prior art systems, the invention relies upon air-conducted sound picked up in the residual air space between the hearing protector and the ear drum. The microphone which picks up the sound is a bi-polar, directional, high-level type sensor, capable of delivering the high-intensity sounds developed under a hearing protector while the worker is talking in the presence of a high ambient background noise level.

The invention employs a unique type of filtering to process the sound picked up by the microphone so as to restore energy lost due to the transmission of the speech signal through the head to the air space under the hearing protector. This specialized filtering restores and enhances the speech so that the intelligibility and naturalness of the speech is improved over what it would be otherwise.

The foregoing and other objects, features, aspects and advantages of the present invention will become more apparent from the following detailed description of the present invention when taken in conjunction with the accompanying drawings.

FIGS. *7a–7e* are frequency response curves of system components according to the invention.

FIG. 8 is a table including examples of component audio response characteristics as graphically presented in FIGS. *7a–7e.*

Figure 9:
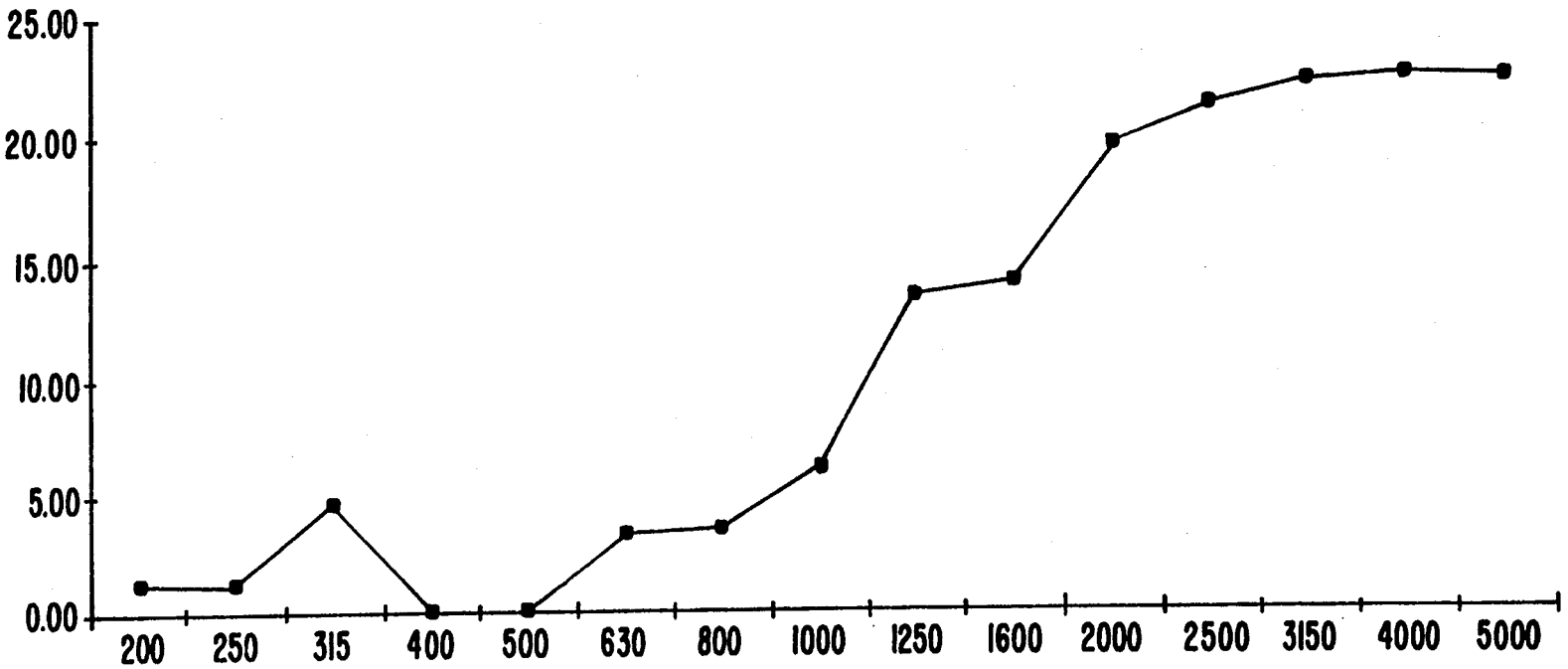

FIG. 9 is a graph of an equalization response curve.

DESCRIPTION OF PREFERRED EMBODIMENTS

Figure 1A:
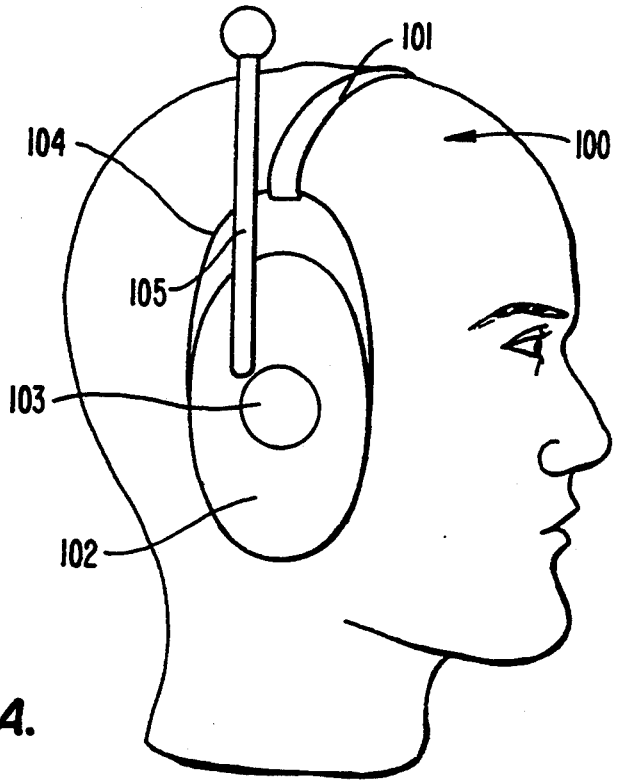
FIGURE 1*a* is a side view of a user wearing an apparatus in accordance with a first embodiment of the invention.
Figure 1B:
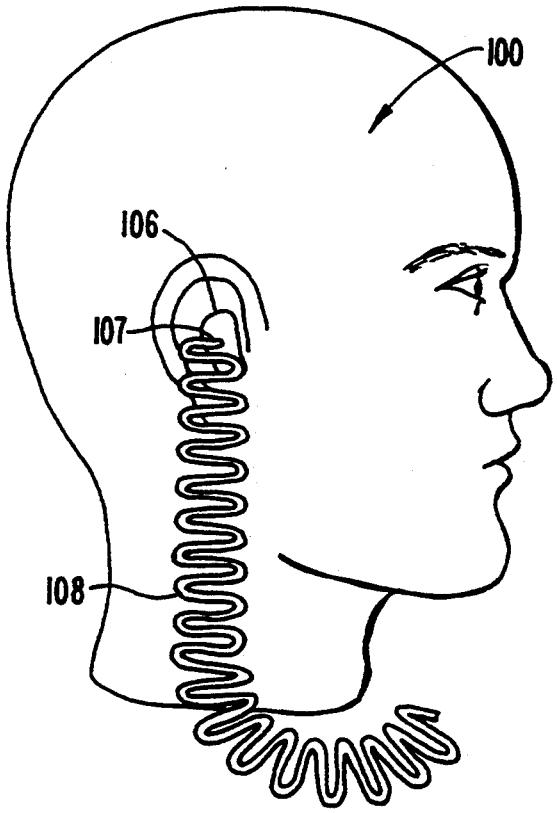
FIGURE 1*b* is a side view of a user wearing an apparatus in accordance with a second embodiment of the invention.

FIGURE 1*a* of the drawings shows a human user 100 wearing a set of earmuffs. The earmuff shell 102 is made from injection molded plastic which is attached to a hinged swivel mount 104 which is further attached to the headband 101 of the device. The electronics package (send or receiver) is housed inside module 103 which respectively supplies or receives radio frequency signals from antenna 105. FIG. 1*b* of the drawings shows a human user 100 wearing a custom-molded shell earplug 106. Wire 108 carries electrical signals to or from the transducers and is plugged into shell 106 at jack 107. The earmuff and custom shell technology used is conventional.

Figure 2:
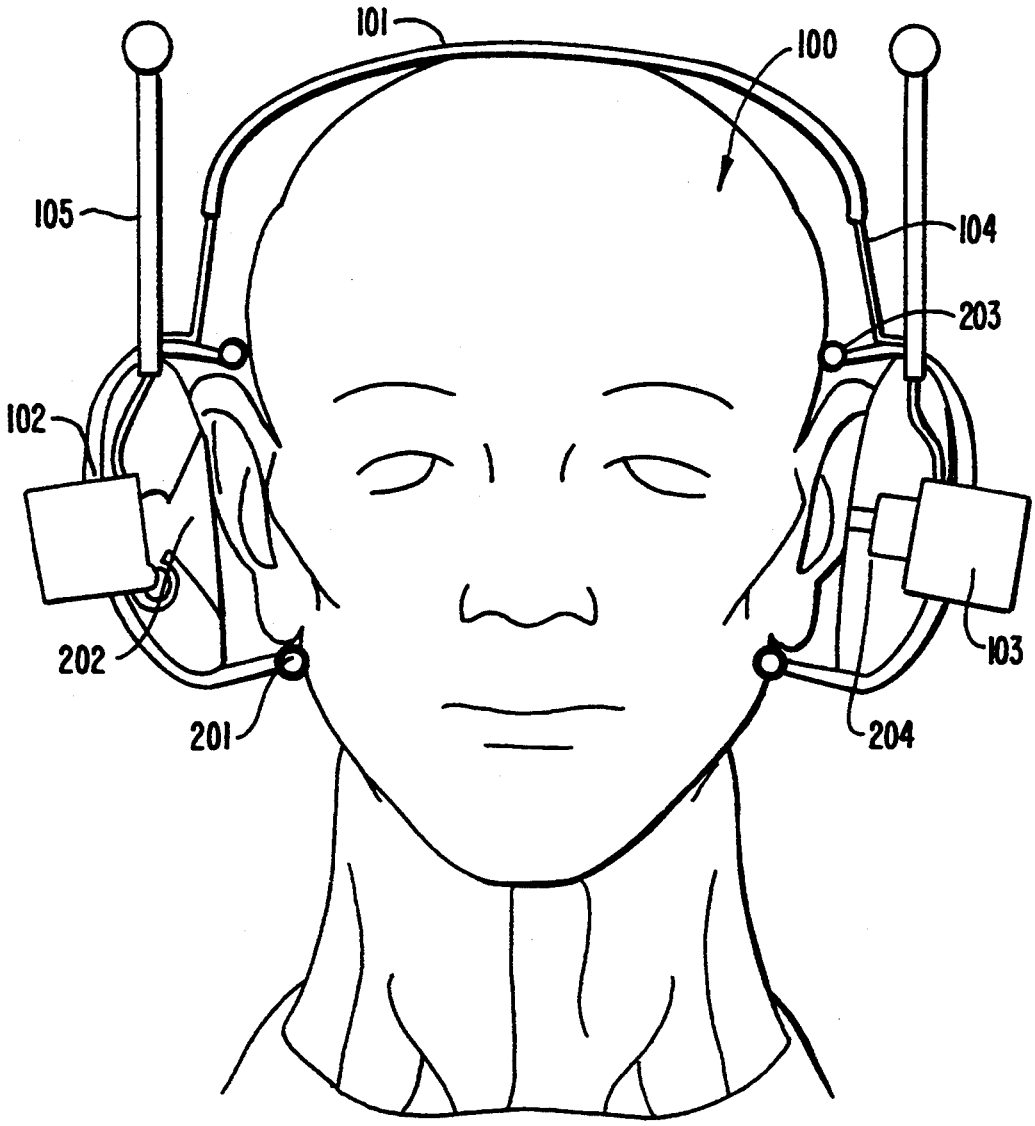
FIG. 2 is a partial front sectional view of the first embodiment of the invention as worn by a user.

Referring to FIG. 2, a human user 100 is fitted with the earmuff implementation of the invention. Also shown are the electronics package 103 formed in one shell of the earmuffs. Headband 101 connects shell 103 with an opposite shell to retain the earmuffs on the user. A hinged swivel mount 104 connects shell 103 to headband 101 to accommodate positioning of the shell on the users head around the outer portions of the ear. An antenna 105 extends vertically out from the shell, providing for reception of radio frequency signals for receiving voice or other sound messages. Referring to FIG. 2, foam/gel filled replaceable cushions 201 including open-cell polyurethane foam inserts 203 provide acoustic insulation between the shell and the user's head. A small loudspeaker 202 is embedded in foam which fills the shell and receive side. A high-level input microphone 204 is embedded in the foam on the transmitting side.

Figure 3:
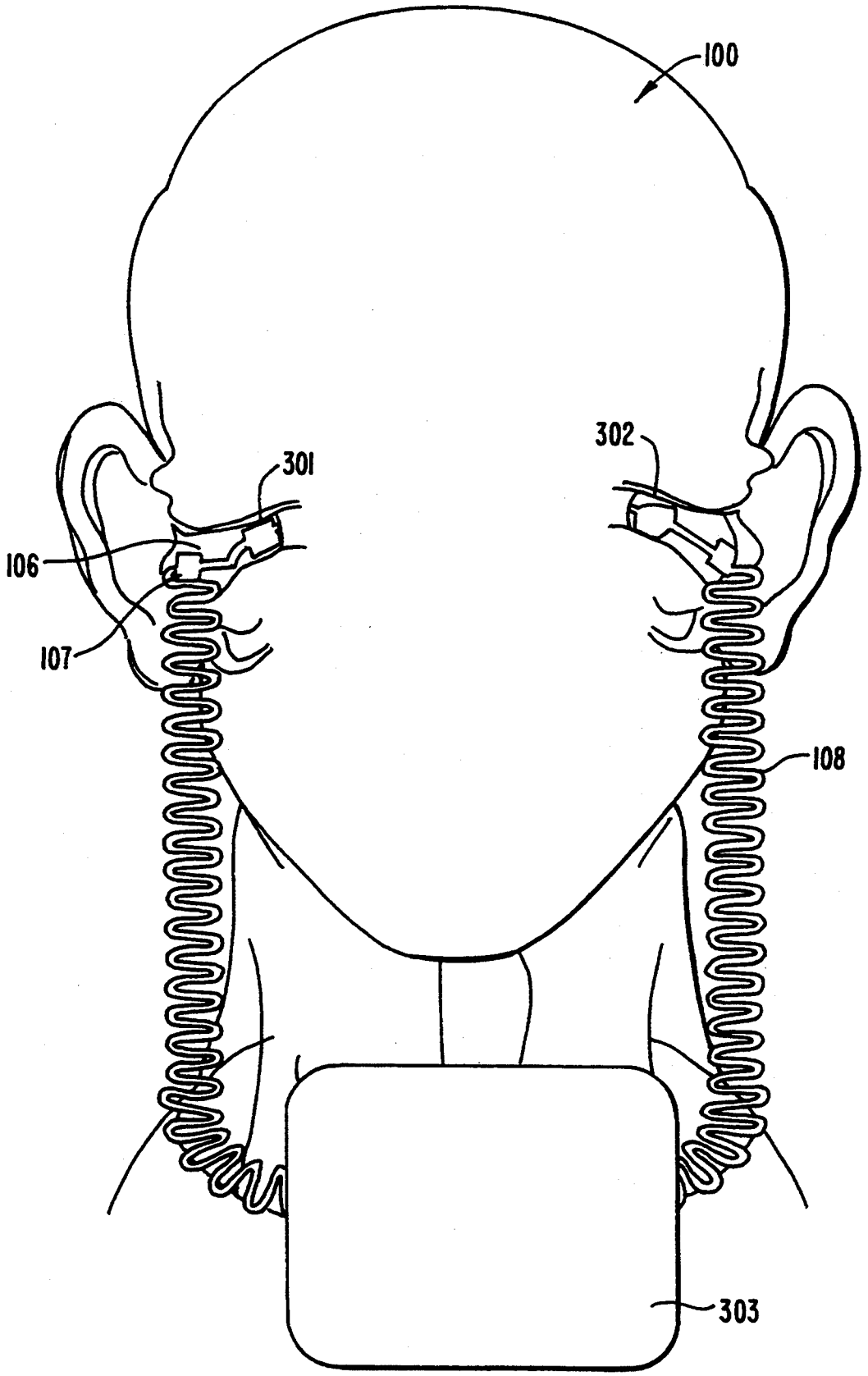
FIG. 3 is a partial front section of the of the second embodiment of the invention as worn by a user.

FIGS. 1*b* and 3 of the drawings shows a human user 100 fitted with the earplug implementation of the invention in a sagittal cut of the head. A custom-molded shell 106 is insertable into each ear canal of the user for detecting speech sounds and transmitting received speech, in each respective ear. A connecting plug 107 attaches a microphone or miniature speaker of each molded shell 106 via wiring 108 to a medallion containing supporting electronics. The wiring also includes antenna leads for radio reception and transmission of speech. A small sub-miniature loudspeaker 301 is included in the custom molded shell for the receiving side, and a small sub-miniature high-level microphone 302 is formed in the opposite custom molded shell for the transmitting side. Medallion 303 contains the power supply and electronics including microphone preamplifier, equalization circuitry, and radio receiver and transmitter.

Figure 4:
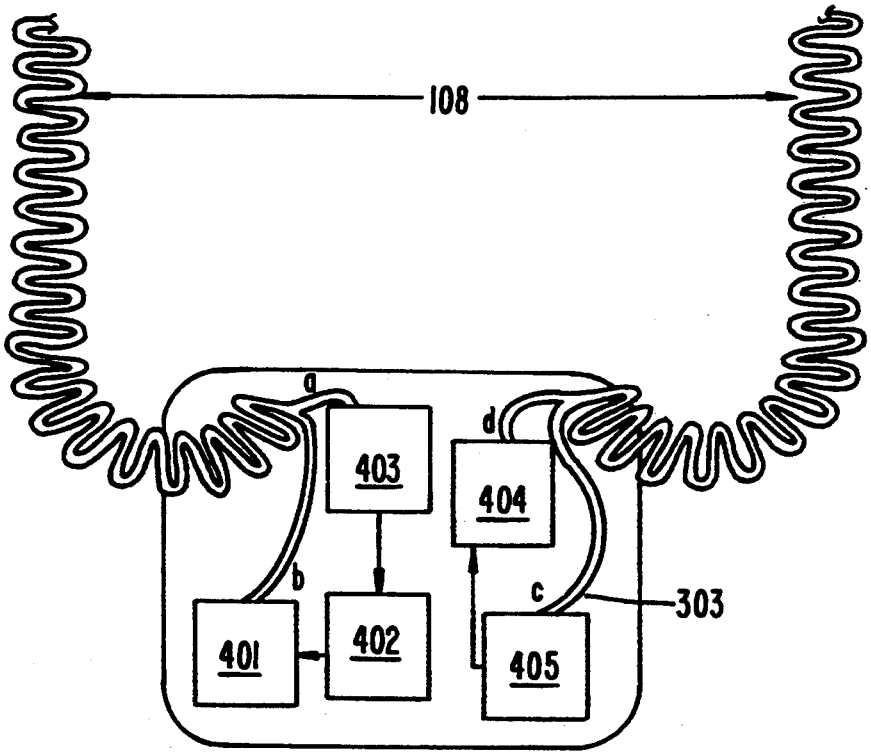
FIG. 4 is a block diagram of an electronic module according to the invention housed in a medallion of the second embodiment of the invention.

FIG. 4 of the drawing shows a block diagram of the medallion 303 containing the electronics for the earplug implementation of the invention. Also shown is the wiring 108 containing the signal lead 108*a* from the sub-miniature high-level microphone 302 which feeds the microphone preamplifier 403 which provides a signal to the optimizing filter 402 which provides a signal to transmitter 401 which then sends the signal to the sending antenna lead 108*b*. Additionally shown is the wiring 108 containing the receiving antenna lead 108*c* which feeds the input receiver 405 which provides signal to amplifier 404 which sends power to the subminiature loudspeaker 301.

Referring to FIG. 4, the electronics according to both embodiments of the invention include a microphone preamplifier 403 receiving low level microphone signals from a microphone positioned proximate or within the outer ear of the user. An equalizer circuit 402 receives amplified signals from the microphone preamplifier and supplies equalized signals to radio transmitter 401. Transmitter 401 is connected to an antenna lead within the wire cord 108 for transmitting speech signals to other users.

On the receive side, radio signals received by receiver 405 are detected and supplied to amplifier 404 which feeds a miniature speaker positioned near or within the other ear of the user.

Figure 5:
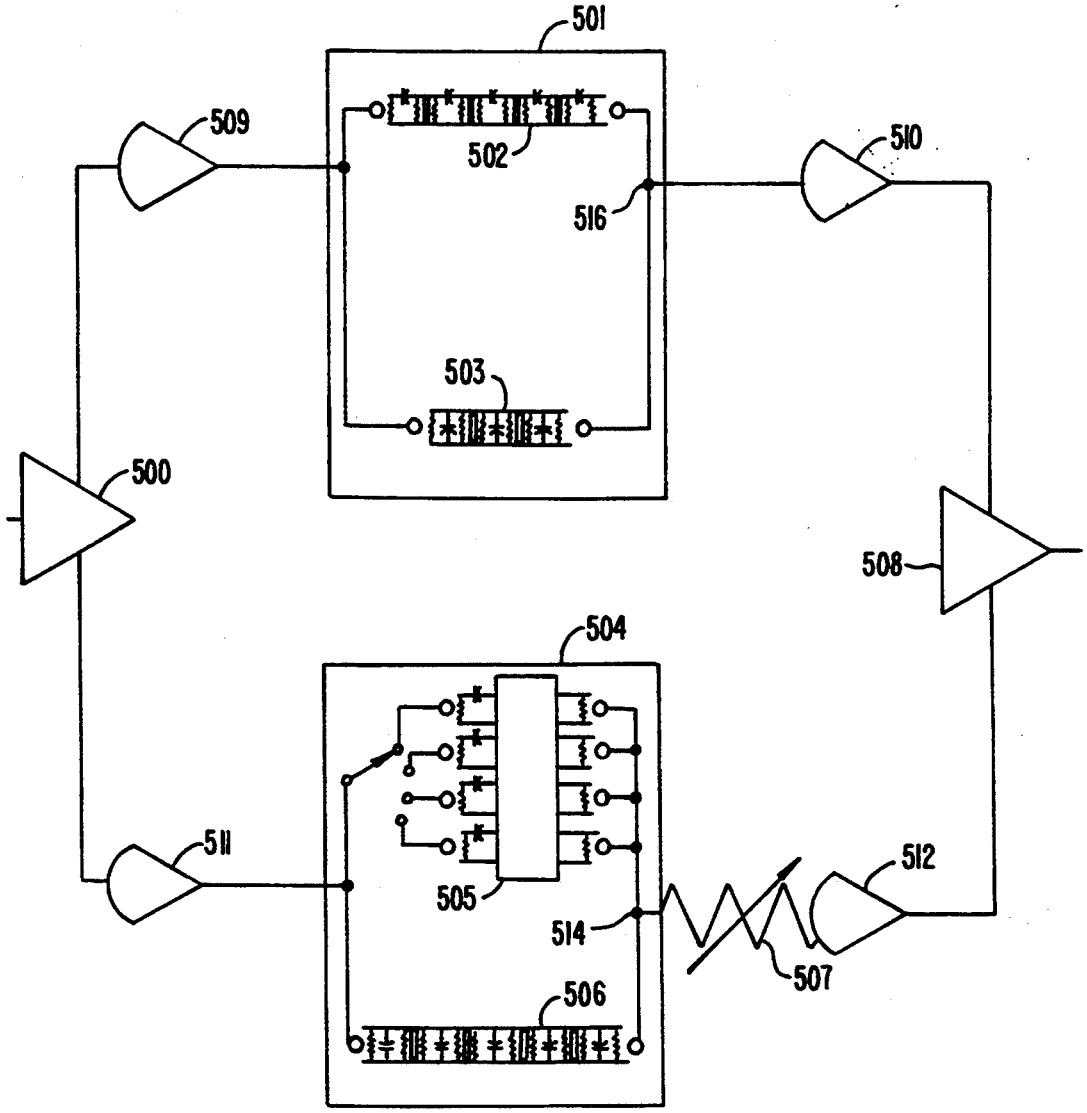
FIG. 5 is a schematic diagram of the optimizing filter which is housed in the electronics package of the earmuff implementation or module of the earplug implementation.

FIG. 5 of the drawings is a block diagram of the optimizing filter contained in electronics package 103 of the earplug implementation and medallion 303 of the earplug implementation of the invention. A signal from microphone 204 or 302 is split into two channels at unity gain amplifier 500 and supplied to operating amplifiers 509 and 511 respectively which feed low-frequency band filter 501 and high-frequency band filter 504. In low-frequency band-pass filter 501 the signal is high-pass filtered by 5th order filter 502 at 100 Hz and low-pass filtered by 3rd order filter 503 at 3000 Hz. The output of low-frequency band filter 501 feeds buffer amplifier 510 and is summed with the signal from high-frequency band-pass filter 504 at summing amplifier 508. In high-frequency band filter 504 the signal is low-pass filtered at 10,000 Hz by 5th order filter 506. Filter 505 is a adjustable high-pass filter with cutoff frequencies of 1500, 2000, 2500, and 3000 Hz and slopes of 6, 12, 18 and 24 dB per octave. Thus the resulting output of high-frequency band-pass filter 504 can have one of 16 possible band shapes. The output of high-frequency band-pass filter 504 is passed through level control 507 before being amplified by amplifier 512. The gain of amplifier 512 is set so that the output of high-frequency filter 504 will be no less than 10 dB and no more than 30 dB higher than the output of filter 511 and will be continuously adjustable within the range.

Figure 6A:
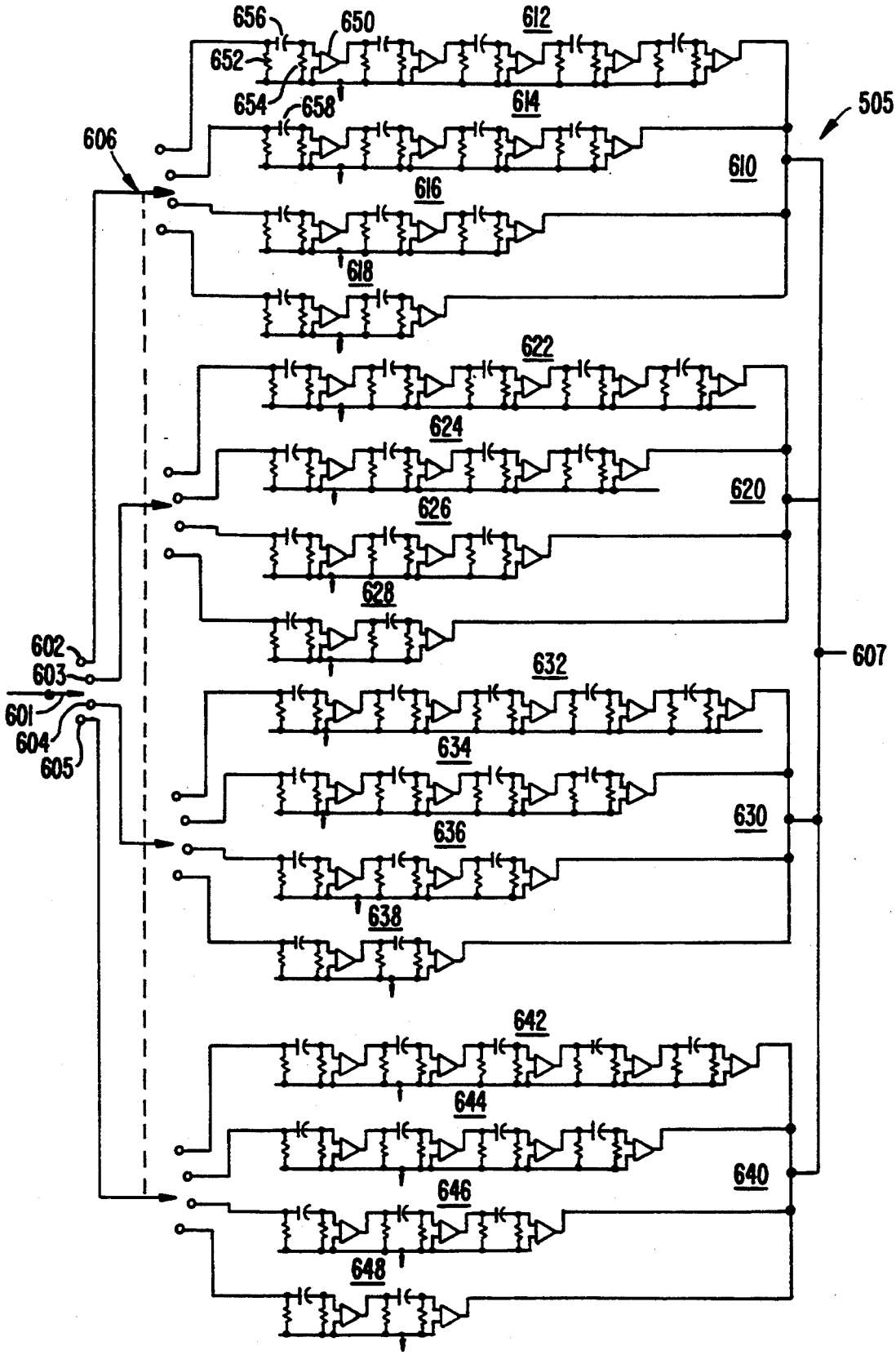
FIGS. 6*a* and 6*b* are schematic diagrams of a high pass filter according to the invention.

FIG. 6*a* is a schematic diagram of the filter 505 shown in greater detail. The filter includes four sets of fifth, fourth, third and second order filters for providing selectable high-frequency filter skirt slopes of 24, 18, 12 and 16 dBs per octave, respectively. Each set of filters 612, 622, 632 and 642 provides a respective high-pass filter cut-off frequency of 1500, 2000, 2500 and 3000 hz.

Figure 6B:
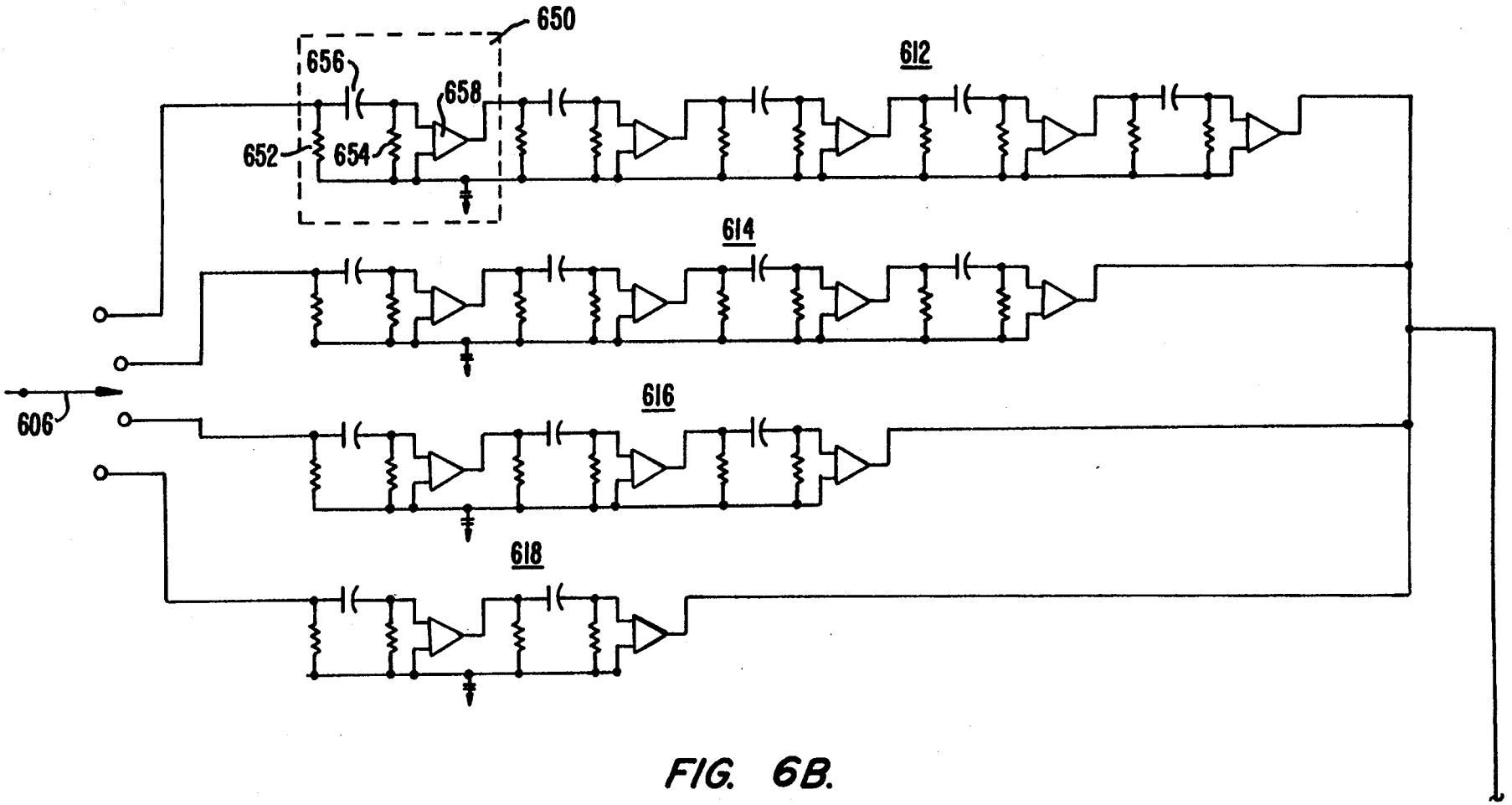

Each filter includes a plurality of series connected filter elements to 50 as shown in FIG. 6*b*. Each filter element includes a balanced T type RC network feeding a unity gain amplifier. An input resistor 652 is bridged across the input line and is followed by a series connected capacitor 652. The output from capacitor 652 is provided to an input terminal of unity gain amplifier 658, the inputs of which are bridged by input resistor 654. Unity gain amplifier 658 are used to isolate each RC circuit from subsequent RC circuits so that filter holes are isolated to avoid interaction therebetween. Fifth order filter 612 provides a filter skirt slope of 24 dB per octave. Fourth-second order filters 614, 616, 618 provide filter skirt slopes of 18, 12 and 6 dBs per octave, respectively. The values of resistors 652 and 654 and capacitor 656 are selected to provide a high-frequency cut-off of 1500, 2000, 2500 or 3000 Hz.

Single pole, four positions which 601 receives an output signal from amplifier 511 and selectively provides the output through contact 602–605 to a respective pole of switch 606 thereby selecting an associated high-frequency cut-off value. Four pole, four position switch 606 selectively supplies the signal to fifth order filters 612, 622, 632 or 642; fourth order filters 614, 624, 634 or 644; third order filters 616, 626, 636 or 646 or second order filters 618, 628, 638 or 648. The outputs of all filters are combined and provided at an output 607 where it is combined at semi-amplifier 514 with the output of low-pass fifth order filter 506 (FIG. 5).

An example of deriving the required filter function $f_{(f)}$ is illustrated in FIGS. *7a–7e* and FIG. 8. FIG. 8 includes a table of values at discrete frequencies for the terms of equation 1, although the frequency response of the loud speaker and microphone are shown as a single term represented by the product of $f_{(s)}*f(m)$. Initially, speech is recorded and measured directly in front of the mouth with the speaker wearing the intended set of hearing protectors according to the invention. Speech is analyzed at one-third octave band levels in dB SPL (sound pressure level with respect to 0.0002 Pascals) as shown in the upper left-hand column of FIG. 8 and graphically depicted in FIG. *7a*. Simultaneously, speech is recorded under the hearing protector according to the invention with a microphone mounted in the hearing protector in accordance with the configuration being implemented. The results of these measurements are shown in the lower left column of FIG. 8 and graphically depicted in FIG. *7b*. The speech sampled at the mouth of the speaker, $f_{(v)}$ is then converted into a linear value using the equation $$f_{(v,i)} = 10^{(dBi/10)} \qquad \textit{(Equation 1)}$$

where $f_{(v,i)}$ is the function for the voice at frequency band i and dBi is the one-third—octave band level for the voice at frequency i.

Similarly, the sound levels under the hearing protector are converted to a linear function where $$f_{hp,i)} = 10^{(dBi/10)} \qquad \textit{(Equation 2)}$$

where $f_{(hp,i)}$ is the function for the voice frequency at band i and dBi is the one-third—octave band level for the speech detected by the microphone according to the invention at the ear, under the hearing protector.

Once the voice detected in the vicinity of the user's mouth $f_{(v)}$ and the voice as detected in the user's ear $f_{(hp)}$ are converted to linear Pascal values, a difference function is calculated by dividing $f_{(hp)}$ by $f_{(v)}$ and inverting that value. Alternatively, the difference function can be computed by subtracting the sound intensity under the hearing protector in dB SPL from the level received at the mouth in dB SPL and taking the anti-log of one-tenth of the resultant difference. This value is shown in the upper fourth column of FIG. 9 and is graphically depicted in FIG. *7c*.

Figure 7A:
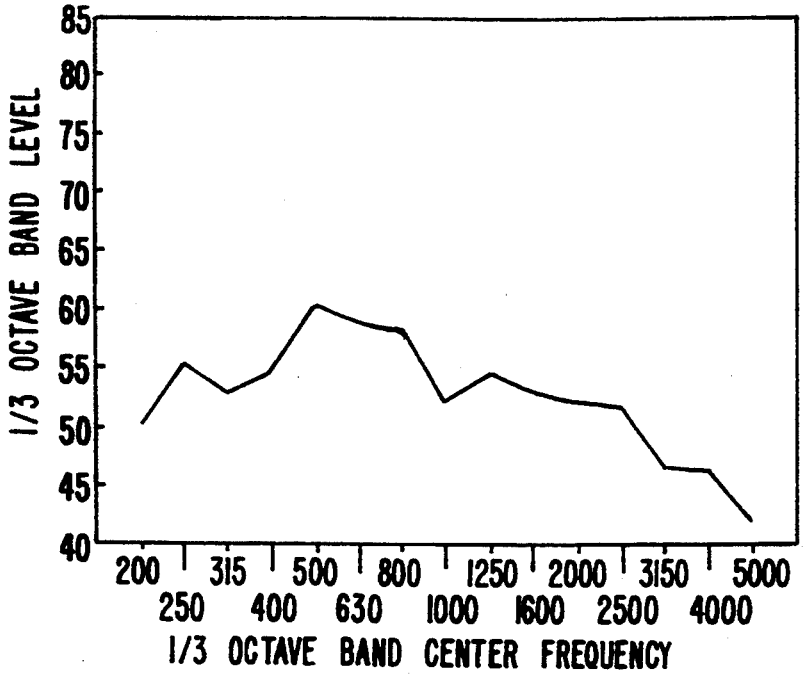
Figure 7B:
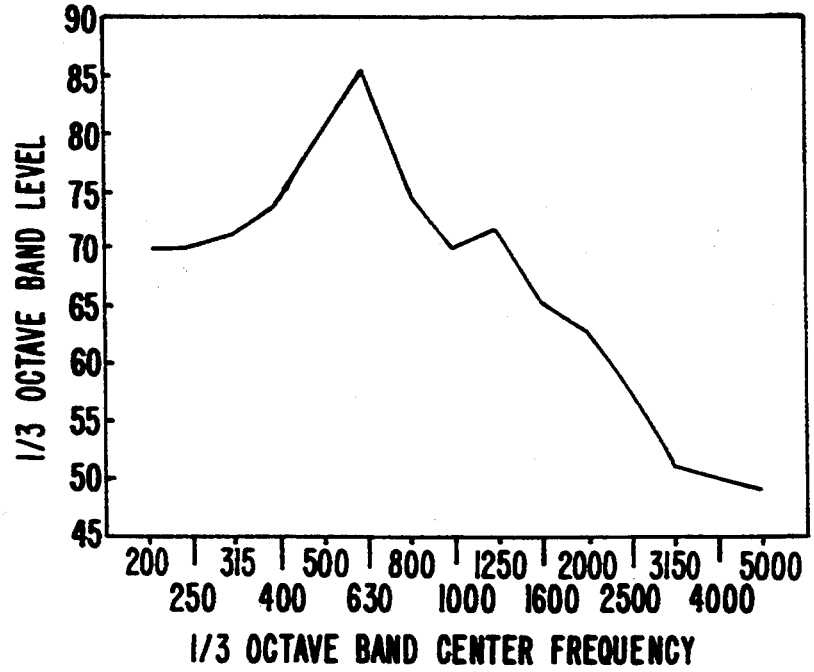
Figure 7C:
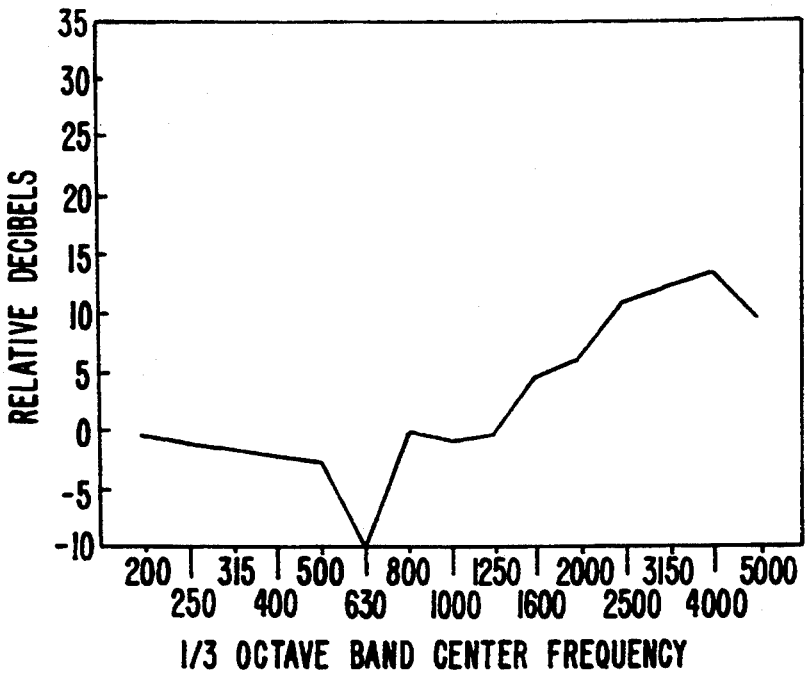
Figure 7D:
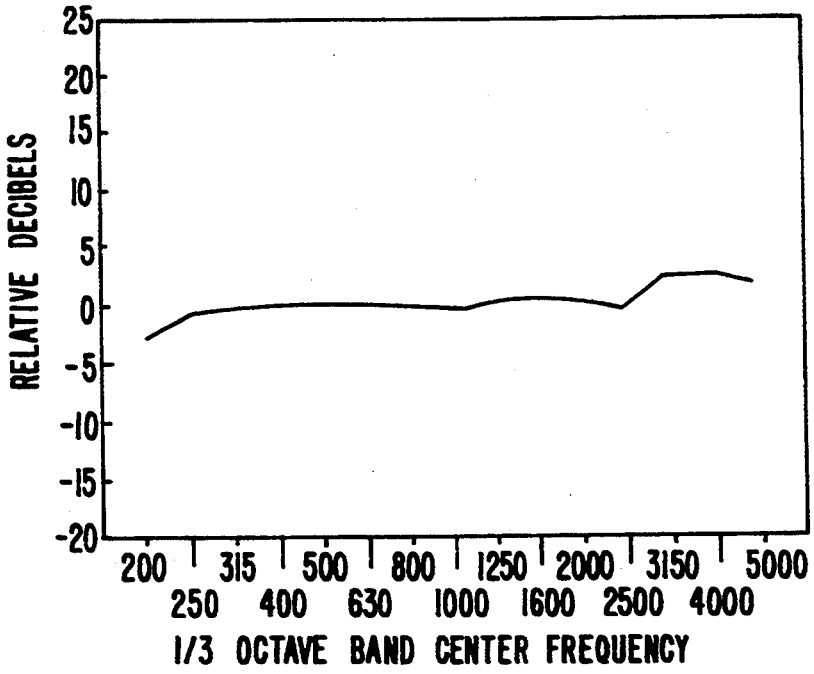

The combined frequency response characteristics of the microphone and subminiature loudspeaker is expressed as $$f_{(s)}*f_{(m)} \qquad \text{(Equation 3)}$$

and is given in the lower fourth column of FIG. 9 and is graphically represented in FIG. 7*d*.

The unsmooth filter function ($f_{(f)}$) is calculated using the equation $$f_{(v)}=f_{(s)}*f_{(m)}*1/(f_{(hp)}/f_{(v)}) \qquad \text{(Equation 4)}$$

This function is shown in the upper fifth column of FIG. 9 and is graphically depicted in FIG. 10.

The filter function is then smoothed by using a moving least-square averaging technique using the following equation:

$$f_{(v,i)}=(((f_{(v,i-1)}\$2)+(f_{(v,i-1)}2)+(f_{(v,i+1)}2)/3))0.5 \qquad \text{(Equation 5).}$$

Values for this function are given in the lower fifth column of FIG. 9.

The resultant values are shown as normalized filter functions. The function is then converted to decibels for each band level by using the equation $$dBf_{(v,1)}=10*log\ (f_{(v,1)}) \qquad \text{(Equation 6).}$$

Figure 7E:
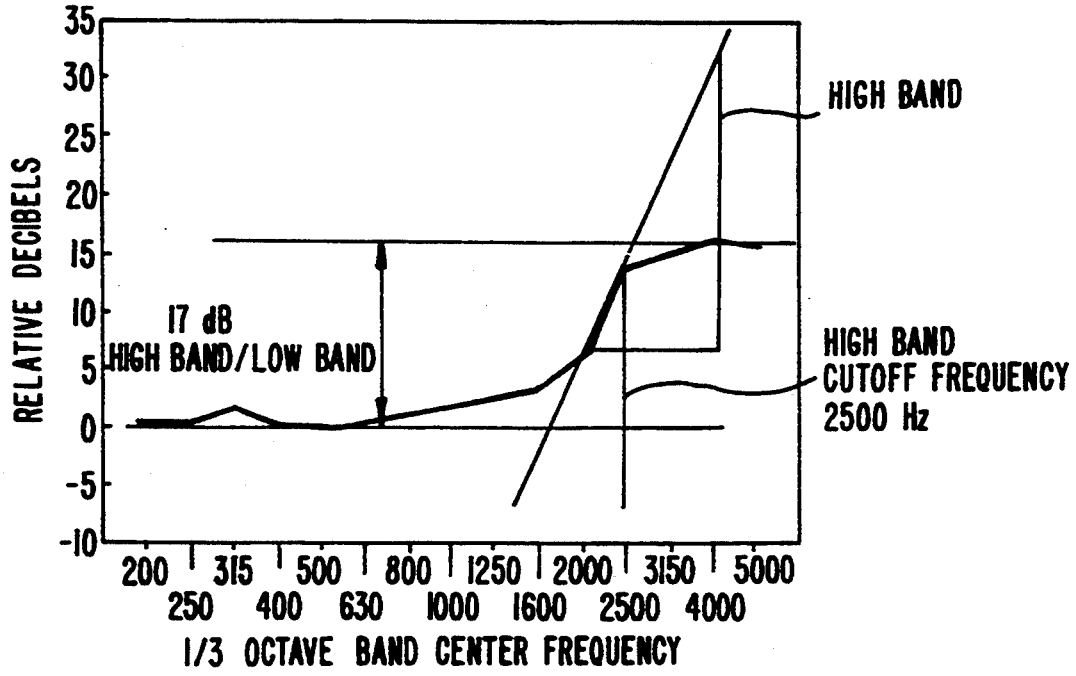

These values for the example are shown in the lower right-hand column of FIG. 9 and are graphically presented in FIG. 7*e*.

Finally, the filter is adjusted to 0 dB at 1,000 Hz. The resulting filter settings in this case require a cutoff frequency of 2,500 Hz, a slope of 24 dB per octave and relative highband to lowband gain of 16 dB. The relative gain between the high and low band is sets by attenuator 507 as shown in FIG. 5.

Measurements of the acoustic properties of the microphone, speaker, and the transfer characteristics of the overall system are made to derive the proper settings for the optimizing filter. The process for equalizing speech from each microphone includes the following steps. Referring to FIGS. 7 and 8, long-term speech spectra is obtained for a sample of male and female talkers from (1) directly in front of the mouth and under the hearing protector design of interest with the microphone located near the intended location for the final implementation. The mouth and hearing-protector spectra are then processed to produce a difference spectra. The difference spectra is then inverted and applied to the frequency response characteristics of the intended microphone and subminiature loudspeaker to derive the optimizing filter setting. The process can be described by the following formula:

$$f_{(f)}=f_{(s)}*f_{(m)}*1/(f_{(hp)}/f_{(v)}, \qquad \text{(Equation 7)}$$

where, $f_{(f)}$ is the frequency response characteristic of the optimizing filter, and $f_{(s)}$ is the frequency response characteristics of the sub-miniature loudspeaker to be used in the implementation, and $f_{(m)}$ is the frequency response characteristics of the microphone to be used in the implementation, and $f_{(hp)}$ is the long-term spectrum of speech under the hearing protector at the location of the microphone, and $f_{(v)}$ is the long-term spectrum of speech from the vocal tract sampled at the mouth of the talker.

It is notable that the described invention has avoided the use of an externally mounted "noise-canceling" microphone, shielded or otherwise. That practice of using such a microphone is in common usage, but places the microphone in the very noise over which the wearer is trying to communicate. The microphone also is something with which the wearer must be concerned. The high-level, bi-polar air-conduction microphone mounted under the foam lining of the earmuff, not touching the head or ear and mounted within the body of the earplug and not touching the ear canal places the microphone in an environment where the noise is already reduced by the hearing protector in such a way that the wearer need have no concern about it.

So, in contrast to prior art systems, in the earmuff implementation of the invention, the microphone is not inserted into the ears before an earmuff is placed over the ears. This device is no more complex to use than a conventional set of earmuffs. It has no gain control for transmission and it has no volume control for reception. The electronics package has been designed to optimally process the speech for intelligibility and comfortable listening.

The earplug implementation does require the fitting of an earplug into both ears. Since the earplugs will be crafted from custom-molded shells to fit each wearer's ears uniquely, such as is the case for all in-the-ear hearing aids, they will be easy to insert and will be inserted consistently time after time. The cording and attached medallion make using such a system no more complex than using a set of corded conventional earplugs.

The achievement of a lightweight, rough-usage, easy to wear, hand-free, full duplex, hearing protection and optimized communication system comprise the notable aspects of the invention.

In summary, the invention is a dual system hearing protector and communication apparatus including a pair or rigid shell enclosures members each having injected molded shell walls which define an interior cavity and fitted with replaceable foam/gel filled cushions suprascribing the ears and filled with an open-celled polyurethane foam rubber or equivalent which have been fitted with electroacoustic transducers and electronics modules and then sealed to provide a noise-reducing enclosure, an alternate embodiment of the invention includes a pair of custom-molded shells made from acrylic material which have been filled with electroacoustic transducers and then filled with a soft silicone base material to insure that the interiors of the shells have no acoustic leaks to provide a noise-reducing earplug.

The resulting system provides a reduction of environmental ambient noise equivalent to a similar set of conventional earmuffs or earplugs which contained no electronics and no transducers. Further, the apparatus is as easy to wear as a standard set of hearing protectors in either earmuff or earplug-with-cord configurations. Use of the invention is also relatively simple. In particular, the apparatus is as easy to use as a telephone, requiring no switching from send to receive mode by either manual or voice-operated means.

Another advantage of the invention is that speech transmitted by the communication system is clear and natural-sounding, and its extremely easy to understand. The intelligibility of the speech is more robust to masking effects by environmental noise which is attenuated by the earmuff or earplug. Increase intelligibility is due to the speech sounds being collected by an air conduction microphone from inside the earmuff or under the earplug in a noise-reduced environment where the noise is reduced by at least 20 dB in the speech frequencies compared to a 10 to 12 dB reduction in noise level from an externally mounted "noise-cancelling" microphone. Speech intelligibility is further enhanced because the speech-to-noise ratio is greater, thus better, for the speech collected inside the earmuff or under the earplug because the intensity of human speech at normal conversation levels is 10 to 12 dB higher in a tightly occluded space around the ear than in front of the mouth where a "noise-canceling" microphone would be located.

Another factor contributing to increased speech intelligibility is caused by processing the speech collected inside the earmuff or under the earplug to account for the effects of the earplug or earmuff occlusion on the spectrum of the speech, thus restoring its clear and natural sound. The result is a natural, full spectrum, speech which is richer in redundant acoustic cues than highly filtered speech and so its intelligibility is more resistant to masking by noises than highly filtered speech.

A further advantage of the invention is that it can be used as a self-contained system so that a worker can better monitor his own speech in a high-level noise environment. A person will talk more precisely when receiving accurate feedback about the precision of speech than when not. The invention can be used for two-way communication by two wearers, each set up with mirroring transmission and reception frequencies.

The invention further supports use in a small to large group situation. Each wearer can have a unique transmission radio frequency, but each group needs to have only one common receiving frequency. A commercially available radio transceiver is used with as many reception channels as wearers and one broadcast channel.

The invention can be used for communication in many situations, some of which are as follows:

a. Worker to worker communication in high-noise-level situations;
b. Worker to group communication in high-noise-level situations;
c. Supervisor to worker(s) communication in high-noise-level situations;
d. Athletic competition where wireless, hands free communication is necessary such as:
   Football games between coaches, spotters, and players,
   Automobile racing for communication between the driver and crews,
   Competitive firing ranges for communication between the shooters and the ranger officer,
e. Work activities where workers must communicate over distances and be protected from noise
   Fire fighters and fire crew supervisors, while fighting the fire and while on route to it;
   Police while on patrol;
   Foundry workers, such as smelter teams.

Although the present invention has been described and illustrated in detail, it is clearly understood that the same is by way of illustration and example only and is not to be taken by way of limitation, the spirit and scope of the present invention being limited only by the terms of the appended claims.

We claim:

1. A speech communications system comprising:

a transducer arranged to convert sound signals into desired acoustic sound waves;

means for mounting said transducer proximate an outer portion of one ear of a user and for attenuating transmission of external sounds into said one ear;

a microphone for converting sounds from the user into electrical sound signals;

means for mounting said microphone in an outer portion of the other ear of the user proximate, the pinna portion of the other ear for acoustic reception of sound waves from the user thereat and for attenuating transmission of the external sounds into the other ear;

an optimizing filter receiving said electrical sound signal from said microphone and selectively passing predetermined frequency ranges of said electrical sound signals to form filtered output signals according to the relationship:

$$f_{(f)}=f_{(s)}*f_{(m)}*1/(f_{hp})/f_{(v)},$$

where, $f_{(f)}$ is the frequency response characteristic of the optimizing filter, $f_{(s)}$ is the frequency response characteristics of the transducer, $f_{(m)}$ is the frequency response characteristics of the microphone, $f_{(hp)}$ is a long-term spectrum of speech at a position of said microphone in said outer portion of the other ear, and $f_{(v)}$ is a long-term spectrum of speech from a predetermined vocal tract.

2. The speech communications system of claim 1 wherein said means for mounting said transducer and said means for mounting said audio detection device comprise respective ear-borne support bodies including elongated protruding portions to be inserted and snugly received in respective outer ear canals of the user.

3. The speech communications system of claim 1 wherein said audio detection device is positioned in relation to said other ear to receive acoustic sound waves and to minimize reception of bone conducted vibration.

4. The speech communications system of claim 1 wherein said audio detection device is responsive to acoustic sound waves transmitted thereto through air contained in the external acoustic meatus of the other ear and is relatively insensitive to bone conducted vibratory waves for supplying said electrical sound signal.

5. The speech communications system of claim 1 further comprising voice activation means for selectively supplying said filtered output signal in response to detecting a level thereof greater than a predetermined threshold level.

6. The speech communications system of claim 1 wherein said means for mounting said transducer and said means for mounting said audio detection device comprise respective shells covering said ears.

7. The speech communications system of claim 6 wherein said shells comprise earmuffs connected to each other by a headband.

8. The speech communications system of claim 1 further including a receiver receiving said first sound signals from an external source and supplying said first sound signals to said transducer and a transmitter supplying said filtered output signals to an external source.

9. The speech communications system of claim 8 wherein said receiver includes means for receiving a first radio frequency signal and for detecting said first sound signals from said first radio frequency signal and said transmitter includes means for encoding said second filtered output signals onto a second radio frequency signal and emitting said second radio frequency signal.

10. The speech communications system of claim 1 wherein said optimizing filter comprises:

a low-frequency band filter for transmitting a first portion of said sound signals having a frequency between a lower frequency limit and a higher first intermediate frequency limit;

a high-frequency band filter for transmitting a second portion of said sound signals having a frequency between a second intermediate frequency limit and a higher high frequency limit, said high frequency limit being greater than said low frequency limit; and means for combining said first and second portions of said sound signals in a predetermined signal ratio to supply said filtered output signal.

11. The speech communications system of claim 10 wherein said second intermediate frequency is not greater than said first intermediate frequency.

12. The speech communications system of claim 10 wherein said low-frequency band filter includes a first multi-pole high pass filter having a low frequency cutoff of said lower frequency and a first multi-pole low pass filter having a high frequency cutoff of said first intermediate frequency, and said high-frequency band filter includes a second multi-pole high pass filter having a selectable low frequency cutoff including said second intermediate frequency and having a selectable low frequency cut-off slope, said high-frequency band filter further including a second multi-pole low pass filter having a low frequency cut-off equal to said high frequency limit.

13. The speech communications system of claim 12 wherein said first and second multi-pole high pass filters and said first and second low pass filters each comprise a series connection of a plurality of filter sections, each filter section including an input node, a first resistor connected between said input node and a common node, a capacitor connected between said input node and an internal node, a second resistor connected from said internal node to said common node, and an amplifier having an input connected to said internal node and to said common node and an output connected to an output node.

14. The speech communications system of claim 12 wherein said second multi-pole high pass filter includes a plurality of selectable sets of high pass filters, high pass filters of each set of high pass filters having a common low frequency cutoff frequency different from high pass filters of other sets of high pass filters, each high pass filter of a set having a different number of filter sections than other high pass filters of the same set, said second multi-pole filter including means for selecting one of said high pass filters of a selected one of said sets of high pass filters.

15. The speech communications system of claim 14 wherein each of said filters includes a plurality of filter sections, each filter section comprising an input node, a first resistor connected between said input node and a common node, a capacitor connected between said input node and an internal node, a second resistor connected from said internal node to said common node, and an amplifier having an input connected to said internal node and to said common node and an output connected to an output node.

16. A method of providing a voice communications signal, comprising the steps of:

obtaining measurements to determine a long-term spectrum of speech produced by a human speaker at a predetermined position within an outer portion of an ear of the speaker;

obtaining measurement to determine a long-term spectrum of speech produced by the vocal tract of the human speaker at a predetermined position proximate the human speaker's mouth;

detecting acoustic waves transmitted through the external acoustic meatus of the ear of the human speaker;

supplying a audio signal in response to the detecting step; and filtering said audio signal to provide a filtered audio signal according to the relationship $$f_{(f)}=f_{(s)}*f_{(m)}*1/(f_{(hp)}/f_{(v)},$$

where, $f_{(f)}$ is the frequency response characteristic of the filtering step, $f_{(s)}$ and $f_{(m)}$ are predetermined frequency response characteristics, $f_{(hp)}$ is the long-term spectrum of speech produced by the human speaker at said predetermined position within said outer portion of said ear, $f_{(v)}$ is said long-term spectrum of speech produced by the vocal tract of the human speaker at said predetermined position proximate the human speaker's mouth.

17. The method of claim 16 further comprising a step of reproducing said audio signal to supply acoustic waves to the other ear of the human speaker using an electromechanical speaker, wherein $f_{(s)}$ is a frequency response characteristics of said electromechanical speaker and $f_{(m)}$ is a frequency response characteristic of a microphone element used by said detecting step.

18. The method of claim 16 further comprising the steps of detecting a level of said filtered audio signal and selectively transmitting said filtered audio signal in response the step of detecting the level of said filtered audio signal.

19. The method of claim 16 further comprising the steps of receiving an audio signal and reproducing said audio signal to supply acoustic wave energy to the other ear of the human speaker.

20. The method of claim 16 wherein said detecting step includes positioning a microphone at said predetermined position, said microphone for supplying said audio signal.

* * * * *